US009458694B2

(12) United States Patent
Petty et al.

(10) Patent No.: US 9,458,694 B2
(45) Date of Patent: Oct. 4, 2016

(54) SYSTEM AND METHOD FOR A SLOTTED LINER SHOE EXTENSION

(75) Inventors: Susan Petty, Shoreline, WA (US); Daniel L. Bour, Granite Falls, WA (US)

(73) Assignee: AltaRock Energy, Inc., Seattle, WA (US)

( * ) Notice: Subject to any disclaimer, the term of this patent is extended or adjusted under 35 U.S.C. 154(b) by 763 days.

(21) Appl. No.: 13/609,049

(22) Filed: Sep. 10, 2012

(65) Prior Publication Data

US 2013/0062062 A1 Mar. 14, 2013

Related U.S. Application Data

(60) Provisional application No. 61/532,408, filed on Sep. 8, 2011.

(51) Int. Cl.

| | |
|---|---|
| ***E21B 33/13*** | (2006.01) |
| ***E21B 33/14*** | (2006.01) |
| ***E21B 33/16*** | (2006.01) |
| ***E21B 43/08*** | (2006.01) |

(52) U.S. Cl.
CPC ..... *E21B 33/14* (2013.01); *E21B 33/16* (2013.01); *E21B 43/086* (2013.01)

(58) Field of Classification Search
CPC ..... E21B 33/13; E21B 33/14; E21B 33/16; E21B 43/086
USPC ..... 166/285, 292, 293, 294, 295
See application file for complete search history.

(56) References Cited

U.S. PATENT DOCUMENTS

| | | | | |
|---|---|---|---|---|
| 5,123,487 | A * | 6/1992 | Harris et al. | 166/277 |
| 6,390,196 | B1 * | 5/2002 | Montaron et al. | 166/290 |
| 6,557,635 | B2 | 5/2003 | Nguyen et al. | |
| 7,032,663 | B2 * | 4/2006 | Nguyen | 166/276 |
| 7,243,724 | B2 | 7/2007 | McGregor et al. | |
| 7,458,423 | B2 * | 12/2008 | Vercaemer et al. | 166/292 |
| 7,625,846 | B2 * | 12/2009 | Cooke, Jr. | 507/260 |
| 2002/0166661 | A1 * | 11/2002 | Nguyen | E21B 43/025 166/51 |
| 2008/0093073 | A1 * | 4/2008 | Bustos | C09K 8/68 166/279 |
| 2008/0105167 | A1 * | 5/2008 | Santra et al. | 106/691 |
| 2010/0000736 | A1 * | 1/2010 | Bour et al. | 166/281 |
| 2011/0011591 | A1 * | 1/2011 | Watters et al. | 166/305.1 |

OTHER PUBLICATIONS

"Packer—Schlumberger Oilfield Glossary" (Google Date Feb. 1, 2002) (Last accessed Sep. 24, 2015).*

The International Search Report and Written Opinion for Corresponding PCT Application PCT/US2012/054506, mailed Nov. 26, 2012 (7 pages).

* cited by examiner

*Primary Examiner* — Doug Hutton, Jr.
*Assistant Examiner* — Silvana Runyan
(74) *Attorney, Agent, or Firm* — Thorpe North & Western, LLP

(57) ABSTRACT

A system and method for extending a slotted liner shoe is disclosed. According to one embodiment, a low density material is injected into a liner having a plurality of openings. The liner is suspended below a cemented casing in a wellbore of a well in a subterranean formation. The low density material extrudes through a lower portion of the liner into an annulus between the liner and the wellbore. A cement is circulated into the liner above the low density material. The cement extrudes through an upper portion of the liner into the annulus between the liner and the wellbore. Water is displaced from the wellbore, and a solid cemented casing string is formed at a desired depth.

21 Claims, 13 Drawing Sheets

SYSTEM AND METHOD FOR A SLOTTED LINER SHOE EXTENSION

The present application claims the benefit of and priority to U.S. Provisional Patent Application Ser. No. 61/532,408 entitled "System and Method for a Slotted Liner Shoe Extension" and filed on Sep. 8, 2011, which is herein incorporated by reference in its entirety.

FIELD

The present application relates to an improvement of wells in subterranean formulations, particularly in geothermal wells. More particularly, the present invention is a system and method for a slotted liner shoe extension.

BACKGROUND

In geothermal wells, water wells, or some oil and has wells, the final drilled interval where production occurs is completed by hanging a liner such as a slotted or perforated casing string or a manufactured well screen from the last cemented casing string above. This last liner in those wells is not cemented in place. Instead, the open annulus between the last liner and the open wellbore is left open or sometimes is packed with gravel. This type of well completion technique stabilizes the production interval of the formation by leaving the maximum area open to the wellbore and reducing pressure drop as fluids enter the wellbore. Resultantly, the flow rate of fluids is increased to the well and the recovery of fluids during production is improved.

While this type of well completion technique reduces the pressure drop from flow into the well and improves production, it makes difficult and sometimes impossible some types of work on the well that are to be performed after the completion. For example, intervals behind the slotted or perforated liner or well screen are difficult to isolate for sealing a desired zone or stimulating zones deeper in the well. In an oil and gas well, a zone that has been produced may start to produce an increased flow of water or fluid injected to enhance oil or gas recovery such as steam, CO2, water or other fluid. The water or other fund may breakthrough in a particular zone. In geothermal wells, shallow zones that are productive may have cooler temperature fluids than expected, or cool injected water may enter the wellbore in the open interval.

Generally, wells that require stimulation may have a cemented casing at a shallower zone than needed to stimulate zones behind the slotted or perforated liner or well screen. This may prevent the build-up of pressures required to stimulate deeper zones because fracturing will occur in the shallow zones. Therefore, the maximum hydraulic pressure that can be applied in the stimulation treatment is limited to the fracture breakdown pressure at the depth of the last casing shoe. The limited hydraulic pressure hampers or disables stimulation of formation deeper in the open hole interval of the well. The potential for fluid production improvement, thus the economic value of the asset is compromised.

Sometimes, a packer is set in the slotted or perforated liner or a well screen, and cement is pumped into the liner above the packer. However, cement is denser than water, therefore cement flows down the annulus between the slotted liner and the wellbore, and enters permeable zones deeper in the well. The intrusion of cement into permeable zones needs to be avoided because this impairs production from these zones.

SUMMARY

A system and method for extending a slotted liner shoe is disclosed. According to one embodiment, a low density material is injected into a liner having a plurality of openings. The liner is suspended below a cemented casing in a wellbore of a well in a subterranean formation. The low density material extrudes through a lower portion of the liner into an annulus between the liner and the wellbore. A cement is circulated into the Liner above the low density material. The cement extrudes through an upper portion of the liner into the annulus between the liner and the wellbore. Water is displaced from the wellbore, and a solid cemented casing string is formed at a desired depth. If the plurality of openings is insufficient for the low density material to pass through to the annulus between the liner and the well bore, a perforating gun is used to enlarge openings.

The above and other preferred features, including various novel details of implementation and combination of elements, will now be more particularly described with reference to the accompanying drawings and pointed out in the claims. It will be understood that the particular methods and apparatuses are shown by way of illustration only and not as limitations. As will be understood by those skilled in the art, the principles and features explained herein may be employed in various and numerous embodiments.

BRIEF DESCRIPTION OF THE DRAWINGS

The accompanying drawings, which are included as part of the present specification, illustrate the presently preferred embodiment of the present invention and together with the general description given above and the detailed description of the preferred embodiment given below serve to explain and teach the principles of the present invention.

Figure 1:
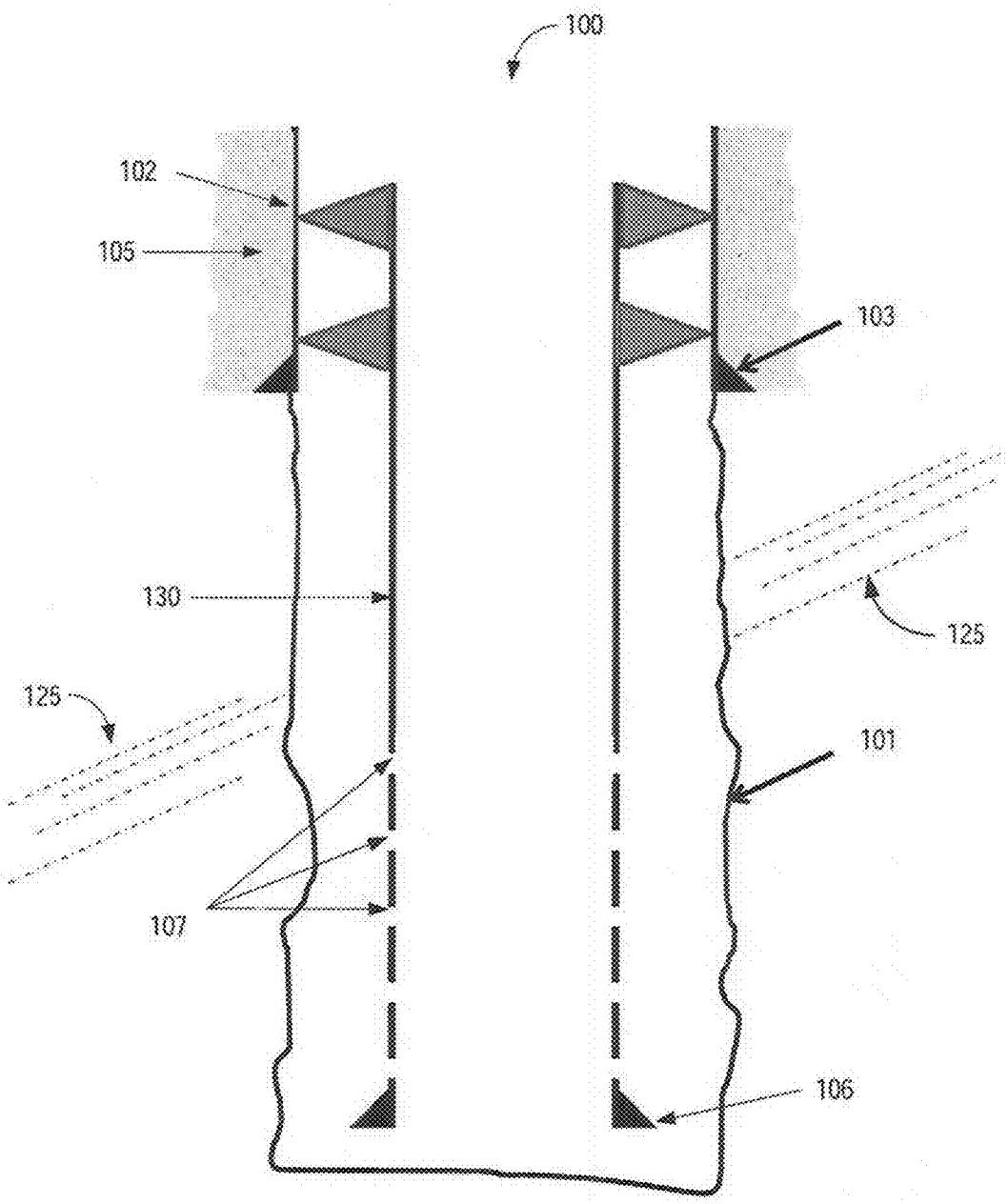
FIG. 1 illustrates a schematic of a slotted or perforated liner suspended within an open hole interval of a subterranean formulation, according to one embodiment.

It should be noted that the figures are not necessarily drawn to scale and that elements of structures or functions are generally represented by reference numerals for illustrative purposes throughout the figures. It also should be noted that the figures are only intended to facilitate the description of the various embodiments described herein. The figures do not describe every aspect of the teachings described herein and do not limit the scope of the claims.

DETAILED DESCRIPTION

A system and method for extending a slotted liner shoe is disclosed. According to one embodiment, a low density material is injected into a liner having a plurality of openings. The liner is suspended below a cemented casing in a wellbore of a well in a subterranean formation. The low density material extrudes through a lower portion of the liner into an annulus between the liner and the wellbore. A cement is circulated into the liner above the low density material. The cement extrudes through an upper portion of the liner into the annulus between the liner and the wellbore. Water is displaced from the wellbore, and a solid cemented casing string is formed at a desired depth.

In the following description, for purposes of clarity and conciseness of the description, not all of the numerous components shown in the schematic are described. The numerous components are shown in the drawings to provide a person of ordinary skill in the art a thorough enabling disclosure of the present invention. The operation of many of the components would be understood to one skilled in the art.

Each of the additional features and teachings disclosed herein can be utilized separately or in conjunction with other features and teachings to provide the present table game. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the claims. Therefore, combinations of features disclosed in the following detailed description may not be necessary to practice the teachings in the broadest sense and are instead taught merely to describe particularly representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced but are not intended to limit the dimensions and the shapes shown in the examples.

The present system and method increases the maximum surface pressure for stimulation without breaking down the formation. Resultantly, the last casing depth is effectively deepened without being physically extended. Therefore, the risk of formation damage caused by cement flowing downward in the well is reduced.

According to one embodiment, the present system and method is used to seal permeable zones behind the liner. Due to lower temperature, high water content, undesirable fluid chemistry, breakthrough of injected fluids or other undesirable qualities, permeable zones are sealed off from producing into the wellbore.

FIG. 1 illustrates a schematic of a slotted or perforated liner suspended within an open hole interval of a subterranean formulation, according to one embodiment. Wellbore 100 is formed by drilling a hole into a subterranean formation. A metal pipe (casing) 102 is secured in the open hole 101 of wellbore 100 by a cement section 105. A last casing shoo 103 is disposed at the bottom of last casing 102. Slotted liner 130 with lateral slots or perforations 107 is suspended from above the last cemented casing shoe 103. A liner shoe 106 is disposed at the bottom of slotted liner 130. Permeable zone 125 is an area below last cemented casing shoe 103 and above perforations or slots 107. In one embodiment, slotted liner 130 is used in an enhanced geothermal system (EGS) where last casing shoe 103 is 2000 ft below the surface, and liner shoe 106 is 10,000 ft below the surface.

Figure 2:
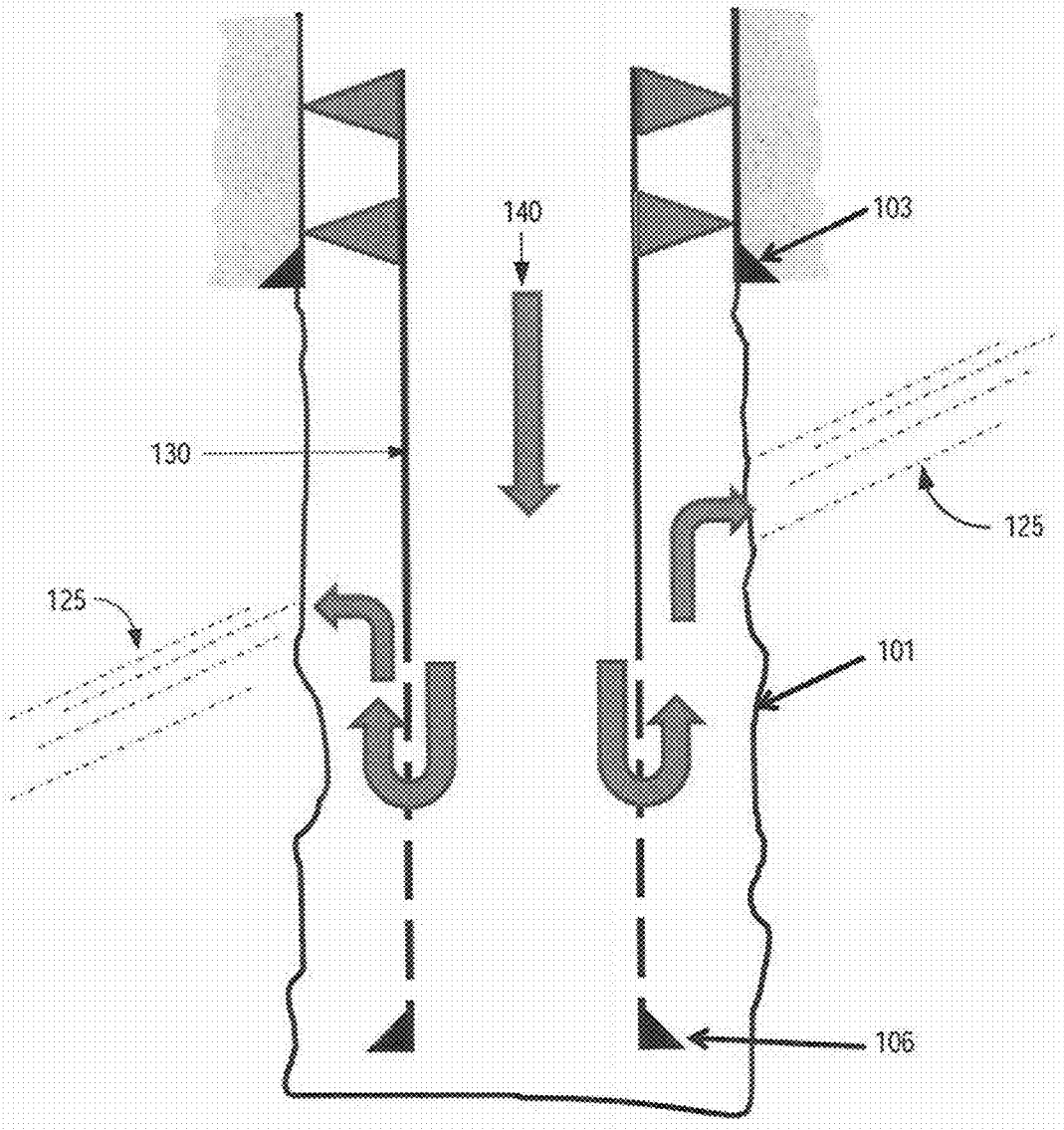
FIG. 2 illustrates an exemplary fluid circulation pattern within a completed well with a slotted liner, according to one embodiment.

FIG. 2 illustrates an exemplary fluid circulation pattern within a completed well with a slotted liner, according to one embodiment. Fluid 140 is injected into a weak zone below the casing shoe 103 through the slots 107 of the slotted liner 130. A natural path for the injected fluid 140 is (1) down the slotted liner, (2) out through the slots or perforations 107, and (3) up outside the slotted liner 130 into the permeable zone 125.

Figure 3A:
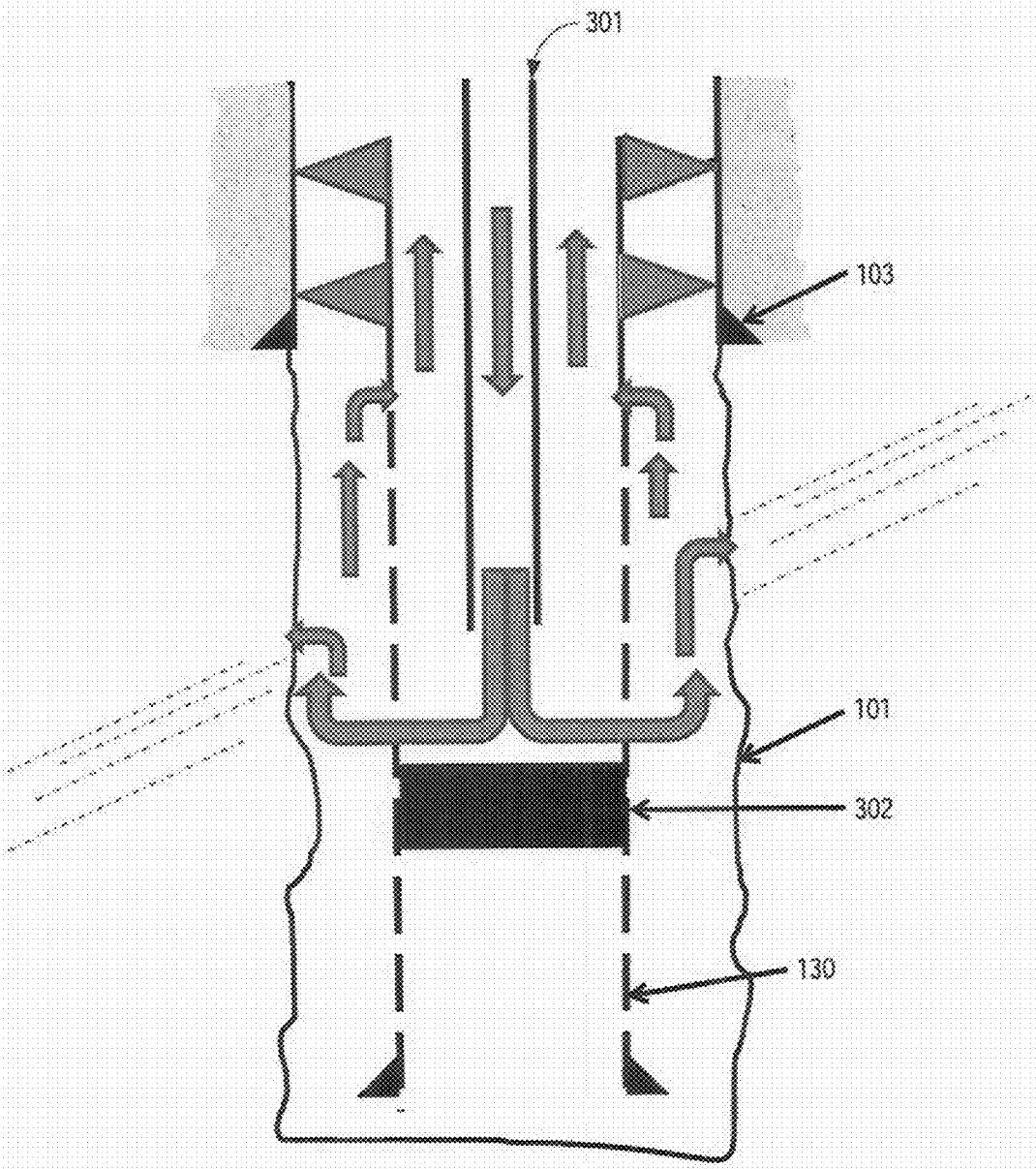
FIG. 3A illustrates an exemplary isolation device set in a slotted liner, according to one embodiment.

FIG. 3A illustrates an exemplary isolation device set in a slotted liner, according to one embodiment. Isolation device 302 may be a drillable packer, cementing basket, bridge plug or other mechanical isolation device. Isolation device 302 is set in the slotted liner 130 to isolate the upper part of the slotted liner 130 as will be describe below. The isolation device 302 is later drilled out. A low density material is pumped via drill pipe 301 above the isolation device 302 and out through the slots 107 into the annulus between the wellbore and slotted liner 130.

Isolation device 302 is placed in slotted liner 130 below a target zone to be sealed with cement. If the slots or perforations 107 in slotted liner 130 are narrower for a low density material to flow, for example, narrower than 141 inches, slotted liner 130 may be further perforated with a perforating gun to enlarge the exit paths from the low density material.

A drill string 301 is placed into the hole, and a fluid containing low density material 311 is circulated down into drill string 301. The fluid pumped into drill string 301 runs out the slots or perforations 107 that are below the bottom end of drill string 301 and enters into the annulus between the wellbore and the liner 130. The exited fluid from inside of liner 130 out into the annulus backs up into liner 130 through the perforations 107 higher up in the liner 130. The fluid then moves up the annulus between liner 130 and drill string 301 and exits well 100 through valves on the casing at the wellhead. Low density material 311 plugs the open hole interval above isolation device 302 as shown in FIG. 3B.

Figure 3B:
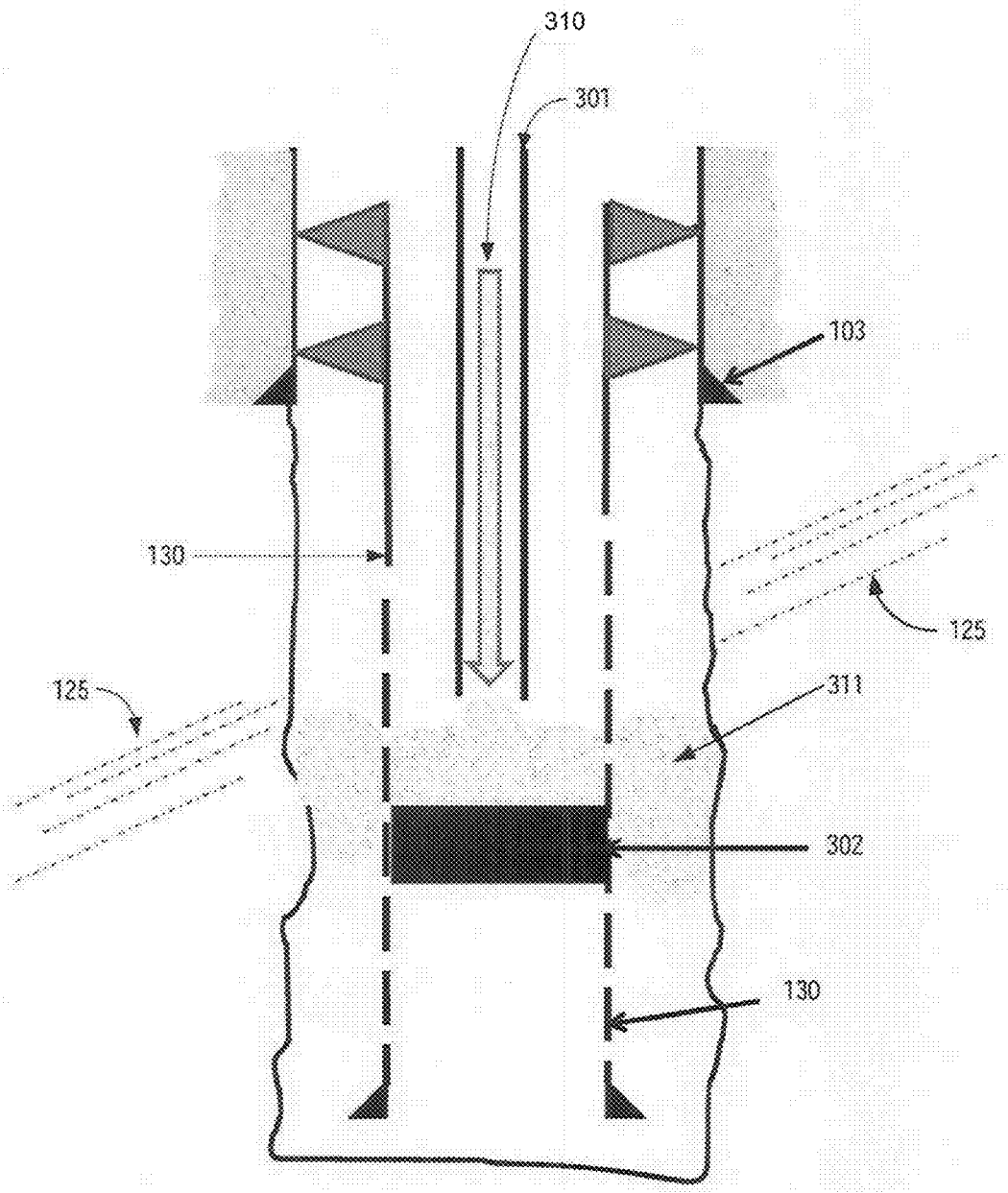
FIG. 3B illustrates an exemplary process for plugging an open hole using a low density material, according to one embodiment.

FIG. 3B illustrates an exemplary process for plugging an open hole using a low density material, according to one embodiment. Cement 310 is pumped into drill string 301.

The circulated cement 310 fills the inside of liner 130 and passes through the slots 107 above the low density material 311. The exited cement fills the annulus between open hole 101 and liner 130, and seals behind liner 130.

According to one embodiment, low density material 311 is balanced to stay at a desired depth. Low density material 311 is emplaced at the desired depth by being pumped as a liquid form into liner 130 above isolation device 302. Low density material 311 flows or expands out through slots or perforations 107 into the annulus between the liner 130 and the open wellbore, and sets up. In one embodiment, low density material 311 is thixotropic so that it has high viscosity when not moving. The density of low density material 311 is low density, close to or lighter than the fluid. Lighter density materials tends to float upward in the annulus between liner 130 and the borehole wall instead of downward into a deeper part of the reservoir that is being developed and containing the oil, gas or geothermal fluid or geothermal heat.

In one embodiment, low density material 311 is a low density viscous polymer gel such as polyvinyl alcohol and polyacrylamide, an anionic polymer of polyacrylamide, or a cross linked copolymer of either of these materials, or another viscous non-cellulosic polymer. In another embodiment, low density material 311 is a low density cement including a thermally degradable cement. In yet another embodiment, low density material 311 has an increased gel strength or is made to have low density by foaming. Foaming agents may be used with nitrogen added as bubbles to cement or to a polymer, or a thermally degradable foamed polymer pellet such as foamed polylactic acid beads may be used. The density of low density material 311 is controlled, to that of the fluid in the borehole.

In yet another embodiment, low density material 311 is a thermally degradable material. When exposed to an elevated temperature of a reservoir rock, a thermally degradable material decomposes over time. A thermally degrading material decomposes or degrades to a soluble or liquid substance. The thermal degradation or decomposition reduces the risk that the material damages desirable permeable zones deeper in the well.

In yet another embodiment, low density material 311 is a thermally degrading particulate material such as polyglycolic acid, polylactic acid, polyhydroxybutyrate, co-hydroxyvalerate, polybutylene succinate, polypropylene fumarate, polycaprolactone, polyethylene terephthalate, polyhydroxyalkanoate, polycarbonate, poly-paraphenylene terephthalamide, polyoxybenzylmethylenglycolanhydride, polyethylene or polypropylene.

In yet another embodiment, low density material 311 is a foamed cement. The foamed cement may be a cement that thermally degrades. For example, such thermally degrading foamed cement is a calcium aluminum cement, ammonium magnesium phosphate sorel cement, magnesium phosphate sorel cement, or magnesium potassium phosphate sorel cement.

In yet another embodiment, low density material 311 is a thermally degrading particulate material. For example, such thermally degrading particulate material is polyglycolic acid, polylactic acid, polyhydroxybutyrate, co-hydroxyvalerate, polybutylene succinate, polypropylene fumarate, polycaprolactone, polyethylene terephthalate, polyhydroxyalkanoate, polycarbonate, poly-paraphenylene terephthalamide, polyoxybenzylmethylenglycolanhydride, polyethylene, or polypropylene.

In another embodiment, the thermally degrading particulate material is an inorganic material such as boehmite, sorel cement, magnesium sulfate sorel cement, magnesium chloride sorel cement, calcium aluminum cement, ammonium magnesium phosphate sorel cement, magnesium phosphate sorel cement or magnesium potassium phosphate sorel cement, aluminum hydroxide, magnesium oxide, and other water soluble inorganic material.

The thermally degrading particulate material is circulated up an annulus between the liner and the wellbore and into permeable zones behind the liner. After circulation, the thermally degrading particulate material in a high temperature portion of the wellbore degrades allowing production from or injection into only a high temperature part of the well.

A proper selection of a chemically and/or thermally balanced low density material protects the reservoir rock from formation damage caused by the cement flowing down the borehole or from a non-degradable low density material. The material may be selected to degrade at a temperature of a deeper reservoir rock, but remain in place at a lower temperature of a zone to be sealed.

Figure 3C:
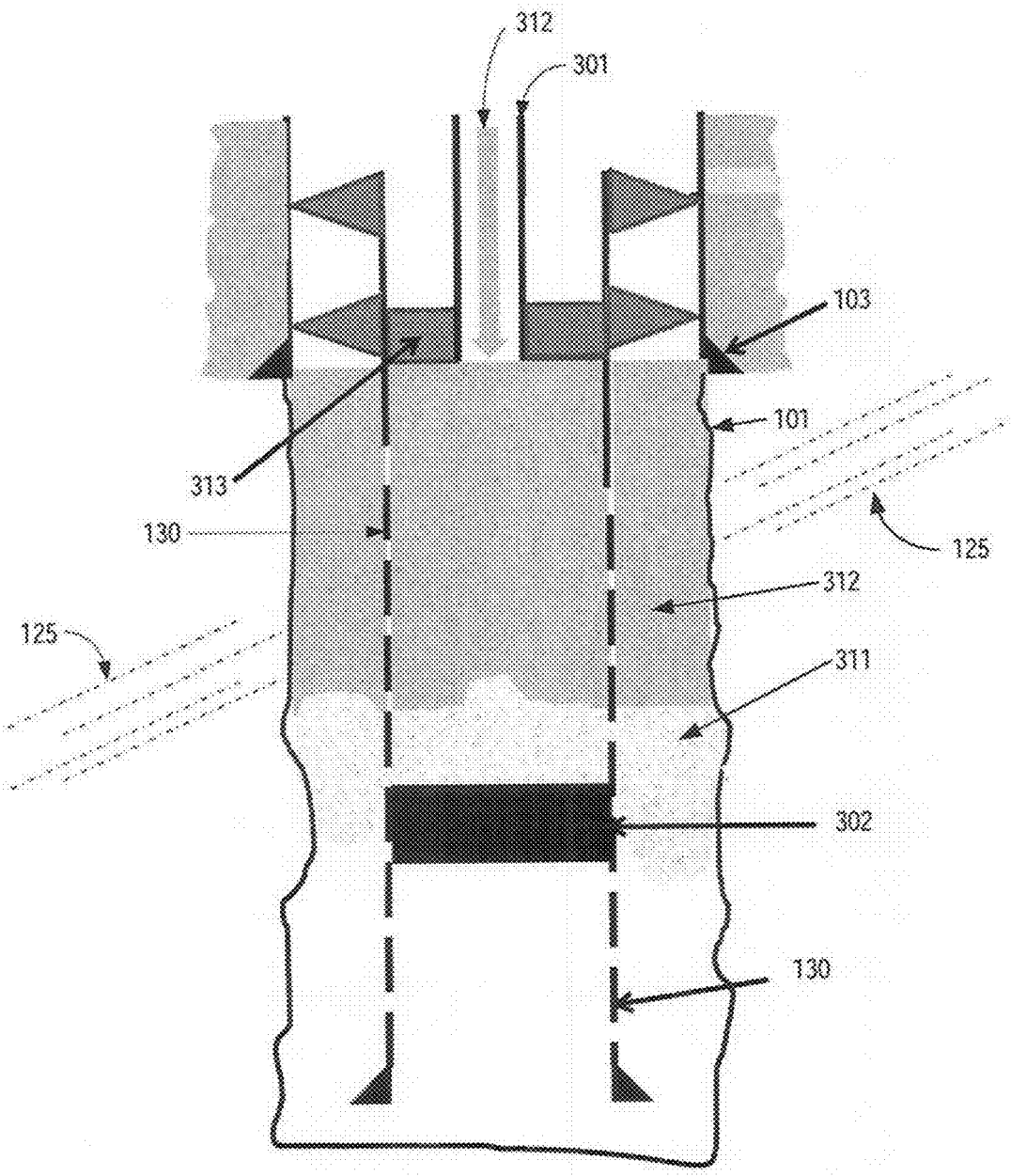
FIG. 3C illustrates an exemplary process for cementing behind a liner according to one embodiment.

FIG. 3C illustrates an exemplary process for cementing behind a liner according to one embodiment. Cement 312 is pumped through drill string 301 into the wellbore and out through slots or perforations 107 in liner 130. Cement 312 may be foamed to decrease the density and improve the displacement upward behind liner 130. Cement 312 is kept front sinking down the annulus outside liner 130 and separated from the reservoir by low density material 311 that is in place. Cement 312 fills the annulus and liner 130 and form a solid cemented easing string at a desired depth. The solid cemented casing string blocks permeable zones 125 behind liner 130 and slots or perforations 107 in liner 130. Undesirable fluid such as water or other fluid filling, the wellbore and the annulus is circulated up through the annulus and back into the cemented casing through the upper most perforations or slots.

Those upper most perforations or slots may need to be enlarged to accommodate this circulation by shooting with a perforating gun prior to the cementing operation. The water displaced by cement 312 exits the annulus between drill string 301 and the casing through valves at the wellhead. An optional expandable or inflatable packer 313 may be used to block cement 312 from entering the annulus between liner 130 and drill string 301.

Figure 3D:
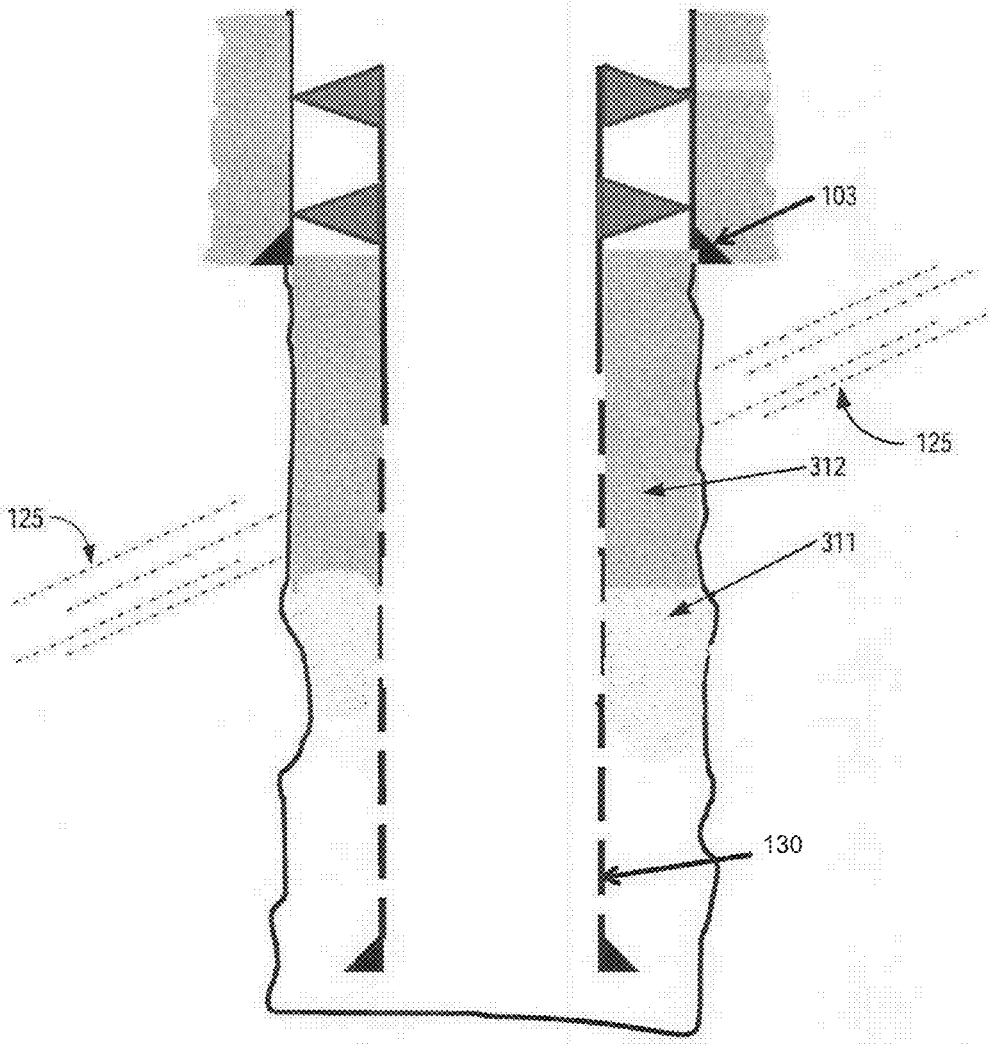
FIG. 3D illustrates a schematic view of a drilled out well, according to one embodiment.

FIG. 3D illustrates a schematic view of a drilled out well, according to one embodiment. Cement 312, isolation device 302, and low density material 311 occupying inside of liner 130 are drilled out and cleaned from inside liner 130. It leaves a hole clean ready for stimulation, injection, or production while filling cracks in permeable zones 125 behind liner 130. Well 100 is ready for flowing with no contribution from the upper, undesirable zones contributing cooler water to a geothermal production well, or water, steam or CO2 to an oil or gas production well. The cemented liner 130 seals off zones in an injection well for geothermal recharge or disposal and cools off injected fluids by moving rapidly to a production well. The present method and system can be used to seal a zone to allow steam, CO2 or other fluid in an enhanced oil recovery operation to move rapidly to production wells, thus preventing short circuiting and early breakthrough of the enhanced oil recovery (EOR) fluid. The cemented liner increases the pressure that is exerted on the wellbore during stimulation to stimulate deeper or higher strength zones during fracturing operations.

Figure 4A:
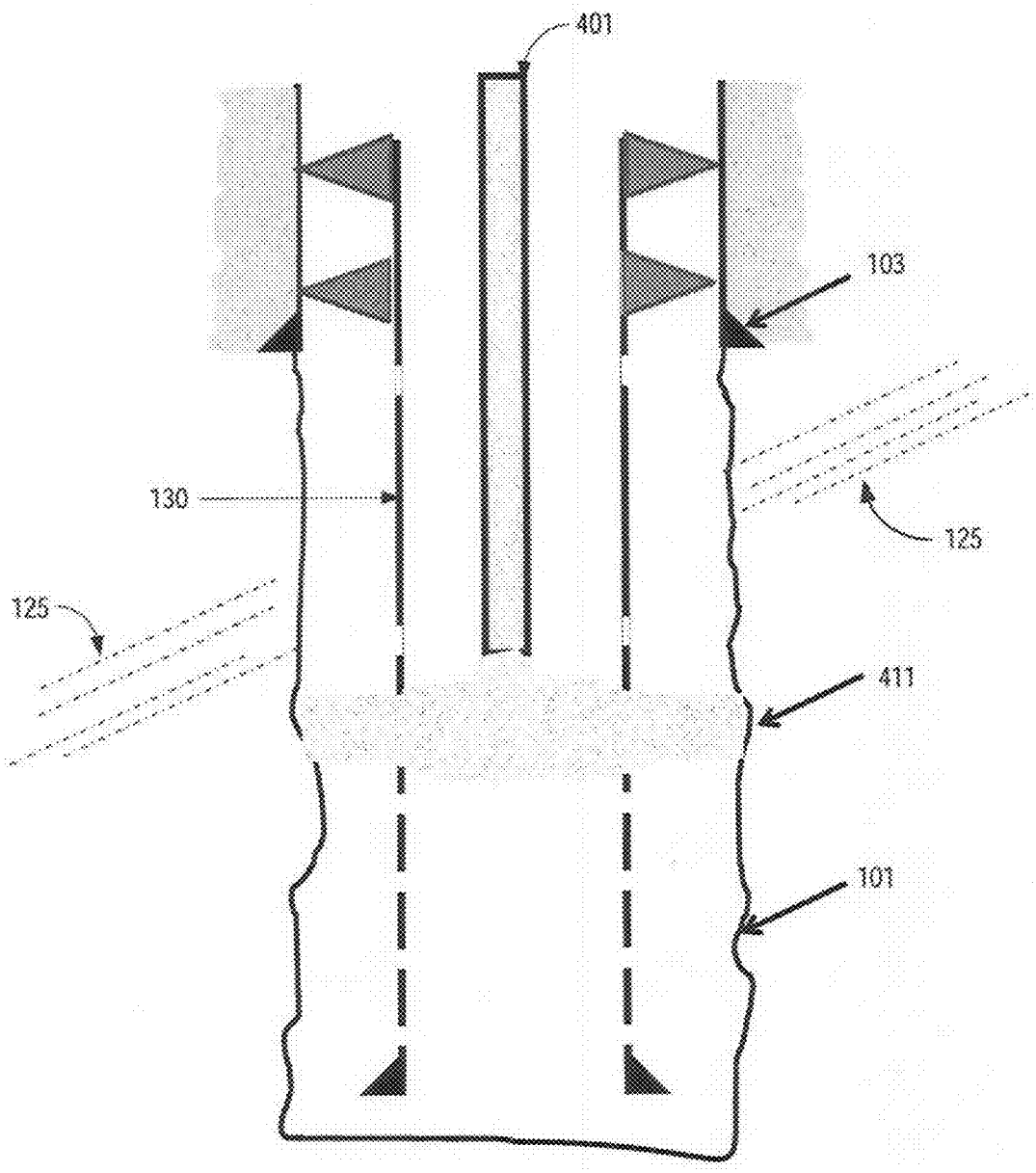
FIG. 4A illustrates a schematic view of a low density plug without an isolation device, according to one embodiment.

FIG. 4A illustrates a schematic view of a low density plug without an isolation device, according to one embodiment.

A low density material 411 such as a viscous gel, lightweight cement, or a thermally degradable low density polymer is pumped through drill string 401 into slotted liner 130. Due to the density balancing, low density material 411 is properly emplaced in the wellbore without needing a mechanical isolation device. In one embodiment, low density material 411 is balanced through density adjustment against the weight of the drilling fluid and sets up to a high strength material. The balanced low density material 411 pumped into liner 130 is designed to float at a desired depth and exit through the slots 107 at the desired depth into the annulus. Slots or perforations 107 in liner 130 may need to be enlarged to a proper size to allow adequate circulation of material 411 behind liner 130 and up the annulus between the wellbore and liner 130.

Figure 4B:
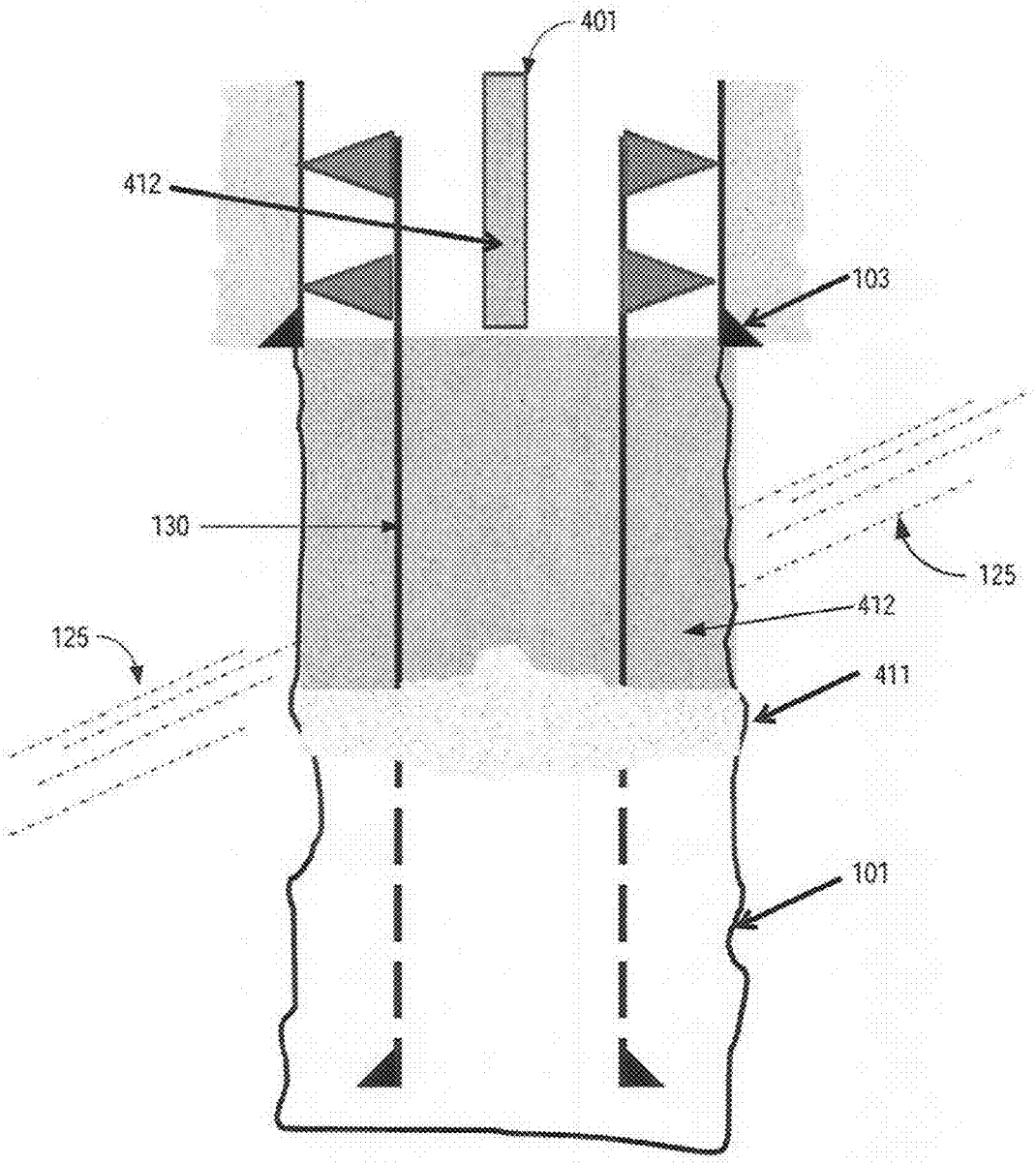
FIG. 4B illustrates an exemplary process for cementing behind a liner, according to one embodiment.

FIG. 4B illustrates an exemplary process for cementing behind a liner, according to one embodiment. Cement 412 is pumped into drill string 401 and sits above the low density material 411 that is already in place. Cement 412 is circulated up the annulus and wellbore to seal the liner slots or perforations 107 in the target zone.

Figure 4C:
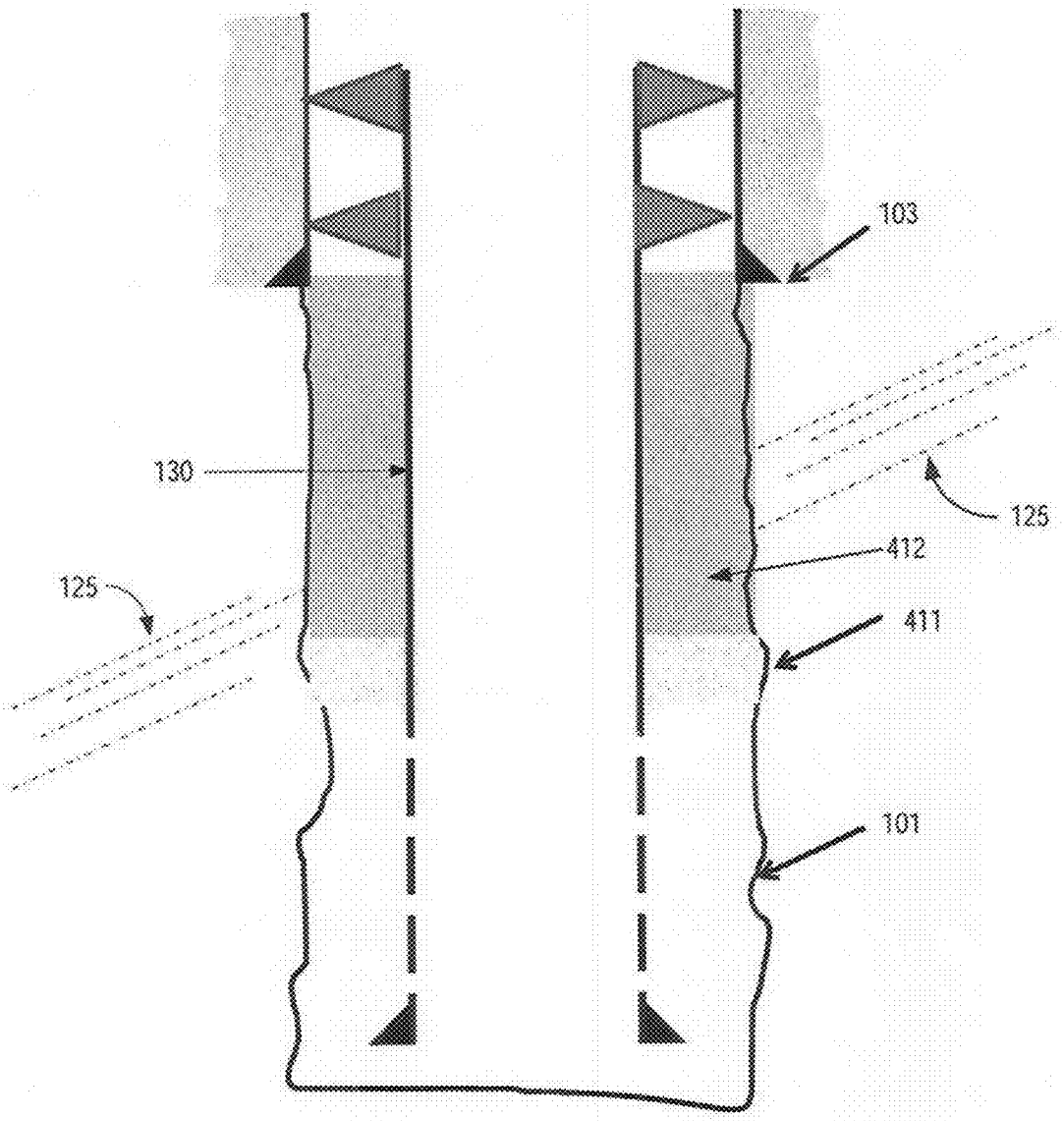
FIG. 4C illustrates a schematic view of a drilled out well according to one embodiment.

FIG. 4C illustrates a schematic view of a drilled out well, according to one embodiment. Cement 412 and low density material 411 occupying inside of liner 130 are drilled out and cleaned from inside liner 130. It leaves a hole clean ready for stimulation, injection, or production while filling cracks in permeable zones 125 behind liner 130. Well 100 is ready for flowing with no contribution from the upper, undesirable zones contributing cooler water to a geothermal production well, or water to an oil or as production well.

Figure 4D:
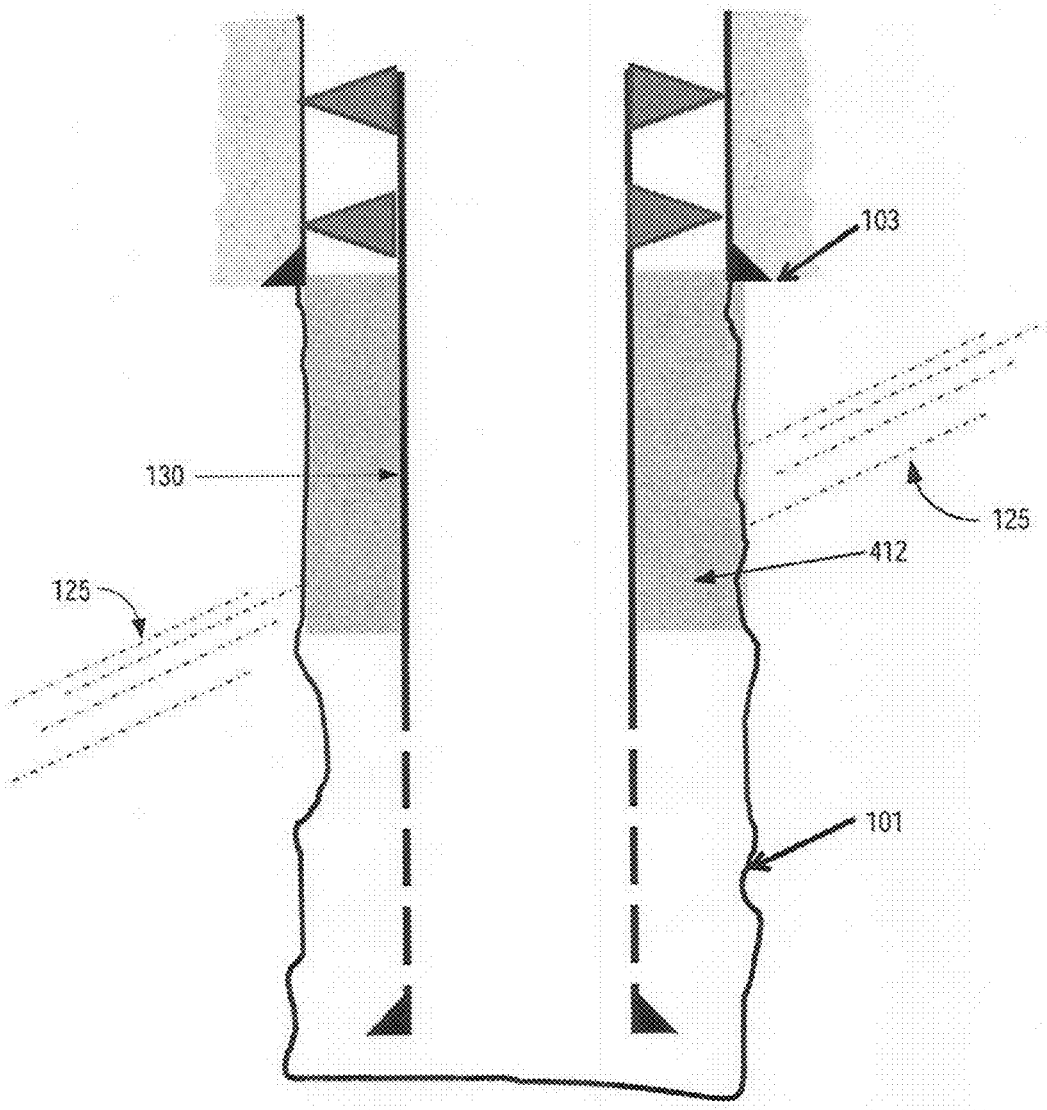
FIG. 4D illustrates a schematic view of a drilled out well after a thermally degradable material is degraded, according to one embodiment.

FIG. 4D illustrates a schematic view of a drilled out well after a thermally degradable material is degraded, according to one embodiment. In this case, low density material 411 is a thermally degradable material. Due to the temperature in the zone, thermally degradable material was degraded, and cement 412 is left to seal behind liner 130 and protects permeable zone 125.

Figure 5A:
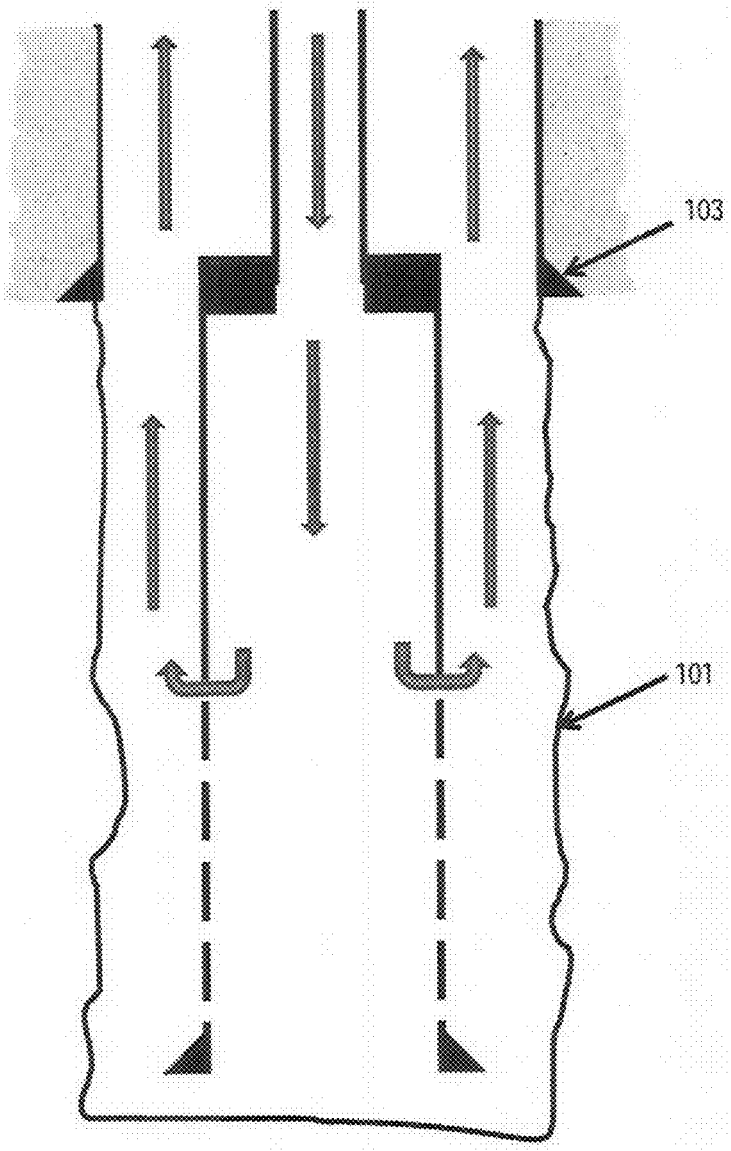
FIG. 5A illustrates an exemplary circulation path of an injected fluid to surface, according to one embodiment.

FIG. 5A illustrates an exemplary circulation path of an injected fluid to surface, according to one embodiment. The circulation path is established in a geothermal well behind the slotted liner and a particulate, thermally degrading solid is injected. The material circulates behind the liner to enter and fill and cracks or permeable zones behind the liner.

Figure 5B:
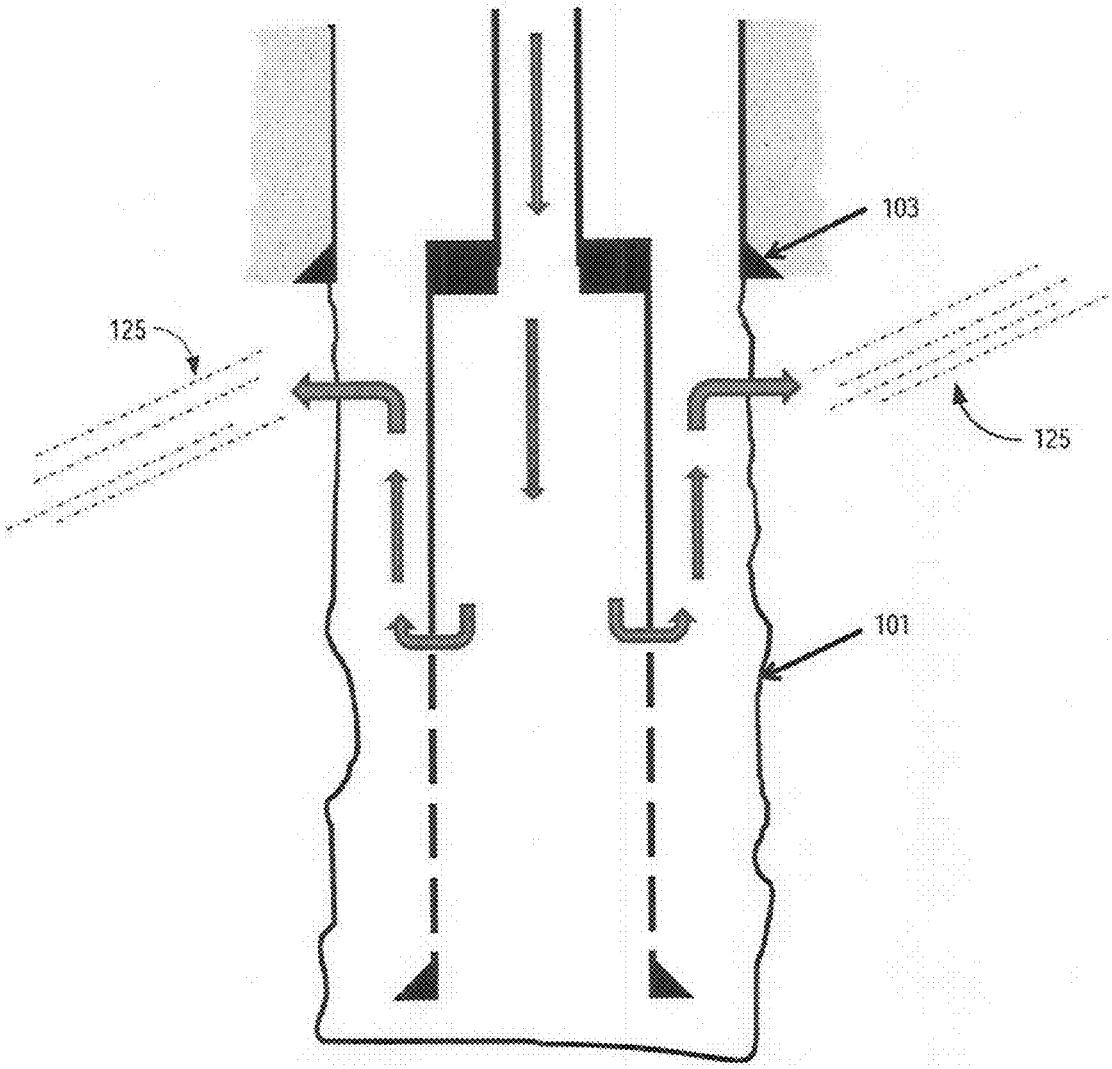
FIG. 5B illustrates an exemplary circulation path of an injected fluid to permeable zones, according to one embodiment.

FIG. 5B illustrates an exemplary circulation path of an injected fluid to permeable zones, according to one embodiment. The particulate solid is displaced with water to three it into the annulus behind liner 130 and into the cracks, fractures or permeable zones 125.

Figure 5C:
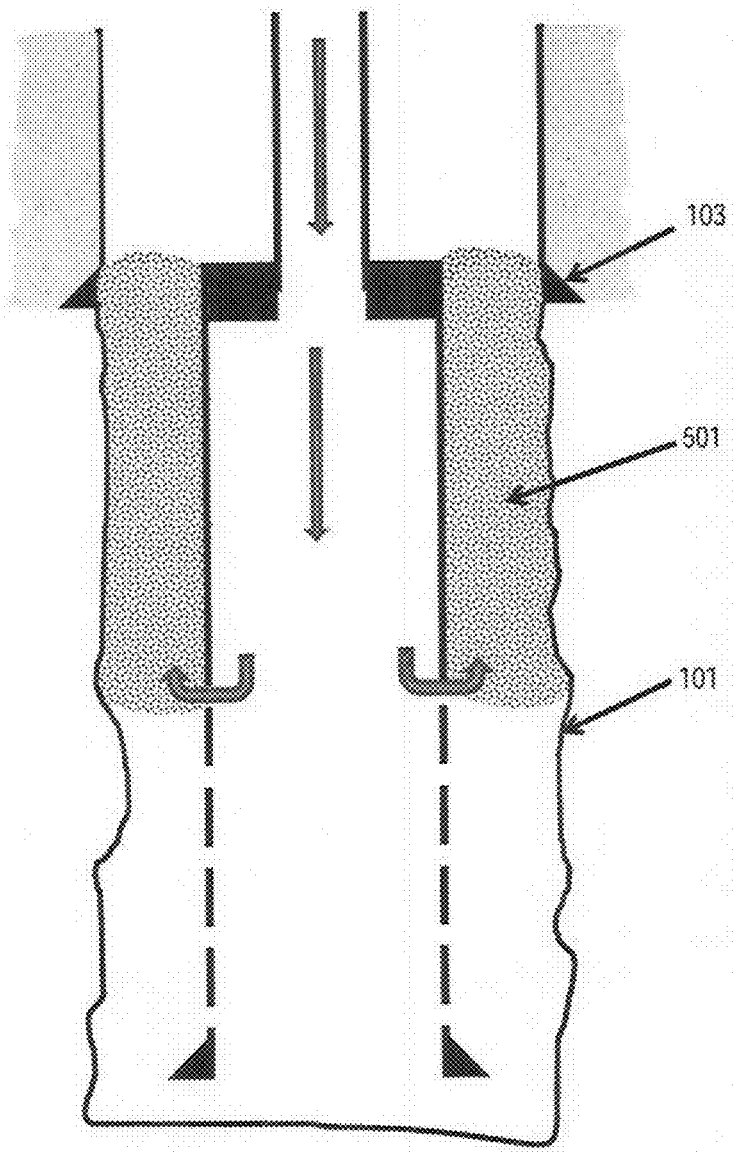
FIG. 5C illustrates an exemplary circulation path of a particulate material injected, into a slotted liner, according to one embodiment.

FIG. 5C illustrates an exemplary circulation path of a particulate material injected into a slotted liner, according to one embodiment. The particulate material degrades in high temperature zones and leaves them open for flow or injection. The particulate material 501 remains in place in low temperature zones, blocking them from now or injection. The geothermal well produces only high temperature fluids or injects into only high temperature zones.

Embodiments as described herein have significant advantages over previously developed implementations. As will be apparent to one of ordinary skill in the art, other similar apparatus arrangements are possible within the general scope. The embodiments described above are intended to be exemplary rather than limiting, and the bounds should be determined from the claims.

What is claimed is:

1. A method comprising:

injecting a thermally degradable material at a desired depth into a liner having a plurality of openings, wherein the liner is suspended below a cemented casing in a wellbore of a well in a subterranean formation, wherein the thermally degradable material has a density about equal to or less than a density of fluid in the wellbore, and wherein the thermally degradable material extrudes through a lower portion of the liner into an annulus between the liner and the wellbore to plug an open hole interval of the well, wherein the thermally degradable material does not flow downward into a deeper part of the well; and circulating a cement into the liner above the thermally degradable material, wherein the cement extrudes through an upper portion of the liner into the annulus between the liner and the wellbore, displacing water from the wellbore and forming a solid cemented casing string, and wherein the cement is kept from sinking down the annulus between the liner and wellbore and separated from the deeper part of the well by the thermally degradable material.

2. The method of claim 1, further comprising removing the cement and the thermally degradable material inside of the liner.

3. The method of claim 1, wherein the thermally degradable material includes one or more of, (a) a thermally degradable cement, (b) a thermally degradable foamed cement;

(c) a thermally degradable particulate material, and (d) a thermally degradable polymer including foamed polymer resin beads.

4. The method of claim 1, wherein the thermally degradable material is injected into the liner over an isolation device.

5. The method of claim 4, wherein the isolation device is one of a drillable packer, a cementing basket, and a bridge plug.

6. The method of claim 1, wherein the thermally degradable material is balanced against the weight of the fluid in the wellbore.

7. The method of claim 1, wherein the thermally degradable material degrades thermally and is removed from the wellbore as a liquid or as a solute in a wellbore.

8. The method of claim 1, wherein the solid cemented casing string protects a permeable zone from fracturing during subsequent injection of the well.

9. The method of claim 1, where the cement used is foamed to increase an upward movement and penetration into the annulus between the liner and the wellbore and to reduce a downward flow of the cement into the wellbore that is capable of damaging a desirable permeable zone.

10. The method of claim 1, where the thermally degradable material is a foamed cement that degrades thermally, and wherein the foamed cement is one or more of a calcium aluminum cement, ammonium magnesium phosphate sorel cement, magnesium phosphate sorel cement or magnesium potassium phosphate sorel cement.

11. The method of claim 1, where the openings are enlarged with a perforating gun to improve circulation of the thermally degradable material and the cement out into the annulus.

12. The method of claim 1, wherein the plurality of openings include one or more of slots, perforations, and mesh.

13. The method of claim 1, where the liner is a well screen.

14. The method of claim 1, where the solid cemented casing string allows stimulation of a zone deeper than the cemented casing string requiring a higher stimulation pressure than a shallower zone.

15. The method of claim 1, wherein the solid cemented casing string prevents production of undesirable fluids, and wherein the undesirable fluids are cold water in a hot geothermal well, or water, steam or CO2 in an oil or gas well.

16. The method of claim 1, wherein the thermally degradable material is a thermally degrading particulate material selected from a group consisting of polyglycolic acid, polylactic acid, polyhydroxybutyrate, co-hydroxyvalerate, polybutylene succinate, polypropylene fumarate, polycaprolactone, polyethylene terephthalate, polyhydroxyalkanoate, polycarbonate, poly-paraphenylene terephthalamide, polyoxybenzylmethylenglycolanhydride, polyethylene and polypropylene.

17. The method of claim 16, wherein the thermally degrading particulate material is circulated up the annulus between the liner and the wellbore and into a permeable zone behind the liner.

18. The method of claim 17, wherein the thermally degrading particulate material in a first portion of the wellbore degrades while the thermally degrading particulate material remains in place in a second portion of the wellbore having a lower temperature than the first portion, allowing production from or injection into only the first portion of the well.

19. The method of claim 17, wherein the thermally degrading particulate material is an inorganic material and is selected from a group comprising boehmite, sorel cement, magnesium sulfate sorel cement, magnesium chloride sorel cement, calcium aluminum cement, ammonium magnesium phosphate surd cement, magnesium phosphate sorel cement or magnesium potassium phosphate sorel cement, aluminum hydroxide, and magnesium oxide.

20. The method of claim 1, wherein the displaced water exits the well through valves at a wellhead or is displaced into cracks, fractures, or a permeable zone of the well.

21. The method of claim 1, further comprising selecting the thermally degrading material to degrade at a temperature of a first portion of the wellbore while remaining in place at a lower temperature of a second portion of the wellbore.

* * * * *